US011484085B1

(12) United States Patent
Grady

(10) Patent No.: US 11,484,085 B1
(45) Date of Patent: Nov. 1, 2022

(54) AIR-CONDITIONED HELMET

(71) Applicant: Christopher Grady, Pacolet, SC (US)

(72) Inventor: Christopher Grady, Pacolet, SC (US)

( * ) Notice: Subject to any disclaimer, the term of this patent is extended or adjusted under 35 U.S.C. 154(b) by 402 days.

(21) Appl. No.: 16/659,651

(22) Filed: Oct. 22, 2019

(51) Int. Cl.
*A42B 3/28* (2006.01)
*A42B 3/30* (2006.01)
*A42B 3/04* (2006.01)

(52) U.S. Cl.
CPC ..... *A42B 3/285* (2013.01); *A42B 3/0406* (2013.01); *A42B 3/30* (2013.01)

(58) Field of Classification Search
CPC ..... A42B 3/285; F25D 2400/26
See application file for complete search history.

(56) References Cited

U.S. PATENT DOCUMENTS 4,998,415 A 3/1991 Larsen
5,940,880 A 8/1999 Phillips
6,760,925 B1 * 7/2004 Maxwell ..... A42B 3/285 2/171.3
D549,884 S 8/2007 Dion
7,296,304 B2 11/2007 Goldsborough
7,827,620 B2 * 11/2010 Feher ..... A42B 3/285 2/171.3
8,156,570 B1 4/2012 Hockaday
9,247,779 B1 2/2016 Aloumanis
9,445,639 B1 * 9/2016 Aloumanis ..... G02B 27/017
2008/0295220 A1 * 12/2008 Webb ..... A42B 3/285 2/171.3
2010/0044023 A1 * 2/2010 Canales ..... F28D 1/0477 165/178
2013/0093585 A1 4/2013 Ambani
2016/0058094 A1 * 3/2016 Vance ..... A42B 3/122 2/413
2018/0103712 A1 4/2018 Krishnan
2019/0021432 A1 * 1/2019 Krishnan ..... A42B 3/286
2019/0150550 A1 * 5/2019 Zoref ..... F25B 21/04

FOREIGN PATENT DOCUMENTS

EP 0050473 1/1983
JP 6955957 * 10/2017 ..... A42B 3/12

* cited by examiner

*Primary Examiner* — Katherine M Moran

(57) ABSTRACT

The air-conditioned helmet is a protective structure. The air-conditioned helmet is configured for use with an individual. The air-conditioned helmet forms a protective shell around the head of the individual. The air-conditioned helmet is a temperature-controlled space within the protective space formed by the air-conditioned helmet. The air-conditioned helmet comprises a helmet structure, cooling structure, and a control circuit. The control circuit and the cooling structure attach to the helmet structure. The cooling structure controls the temperature of the protective interior space formed by the helmet. The control circuit: a) controls the temperature of the protective space formed by the helmet structure; and, b) tracks and announces the GPS coordinates into the protective space formed by the helmet structure.

10 Claims, 6 Drawing Sheets

AIR-CONDITIONED HELMET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of head coverings including helmets, more specifically, a ventilating arrangement for a helmet with a cooling means. (A42B3/285)

SUMMARY OF INVENTION

The air-conditioned helmet is a protective structure. The air-conditioned helmet is configured for use with an individual. The air-conditioned helmet forms a protective shell around the head of the individual. The air-conditioned helmet is a temperature-controlled space within the protective space formed by the air-conditioned helmet. The air-conditioned helmet comprises a helmet structure, cooling structure, and a control circuit. The control circuit and the cooling structure attach to the helmet structure. The cooling structure controls the temperature of the protective interior space formed by the helmet. The control circuit: a) controls the temperature of the protective space formed by the helmet structure; and, b) tracks and announces the GPS coordinates into the protective space formed by the helmet structure.

These together with additional objects, features and advantages of the air-conditioned helmet will be readily apparent to those of ordinary skill in the art upon reading the following detailed description of the presently preferred, but nonetheless illustrative, embodiments when taken in conjunction with the accompanying drawings.

In this respect, before explaining the current embodiments of the air-conditioned helmet in detail, it is to be understood that the air-conditioned helmet is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the air-conditioned helmet.

It is therefore important that the claims be regarded as including such equivalent construction insofar as they do not depart from the spirit and scope of the air-conditioned helmet. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
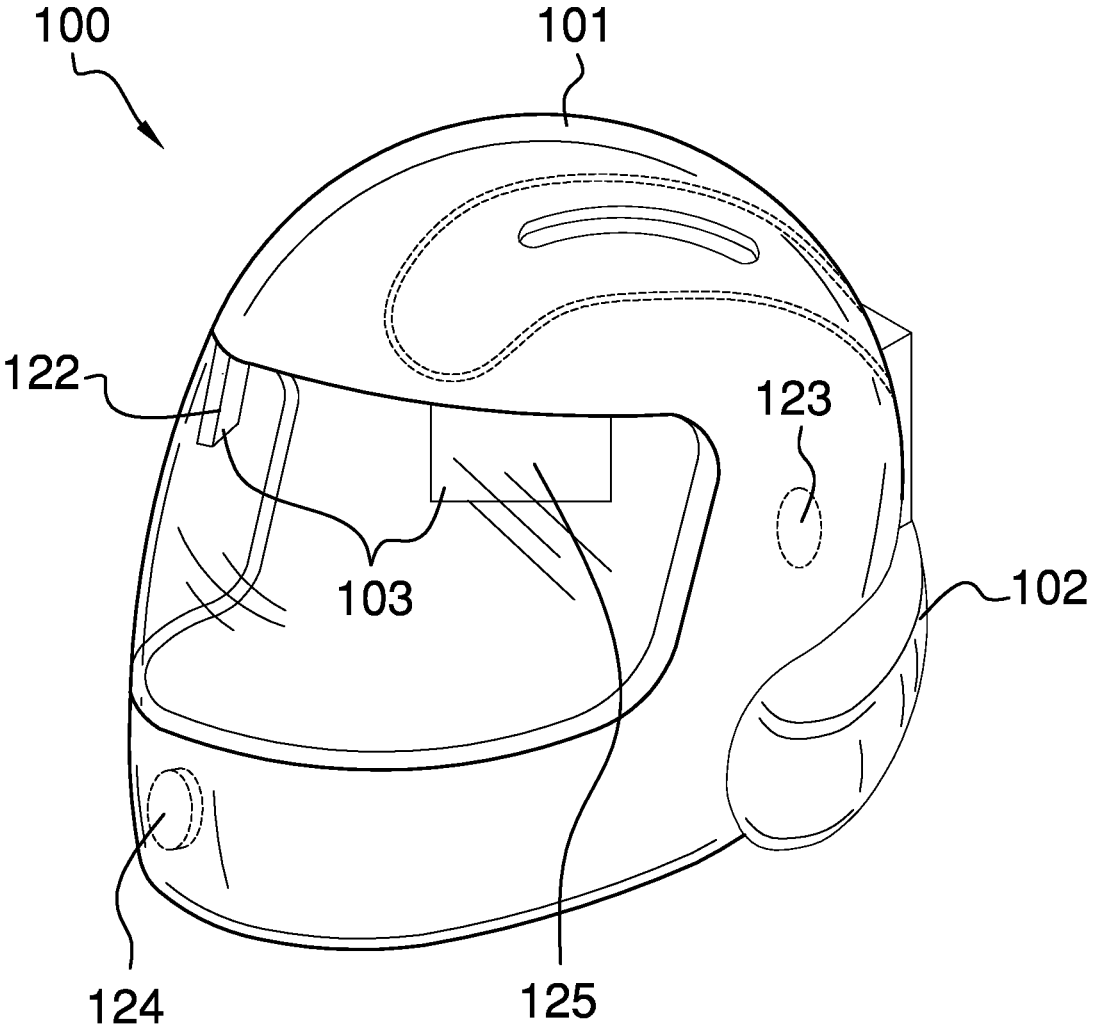
FIG. 1 is a perspective view of an embodiment of the disclosure.
Figure 2:
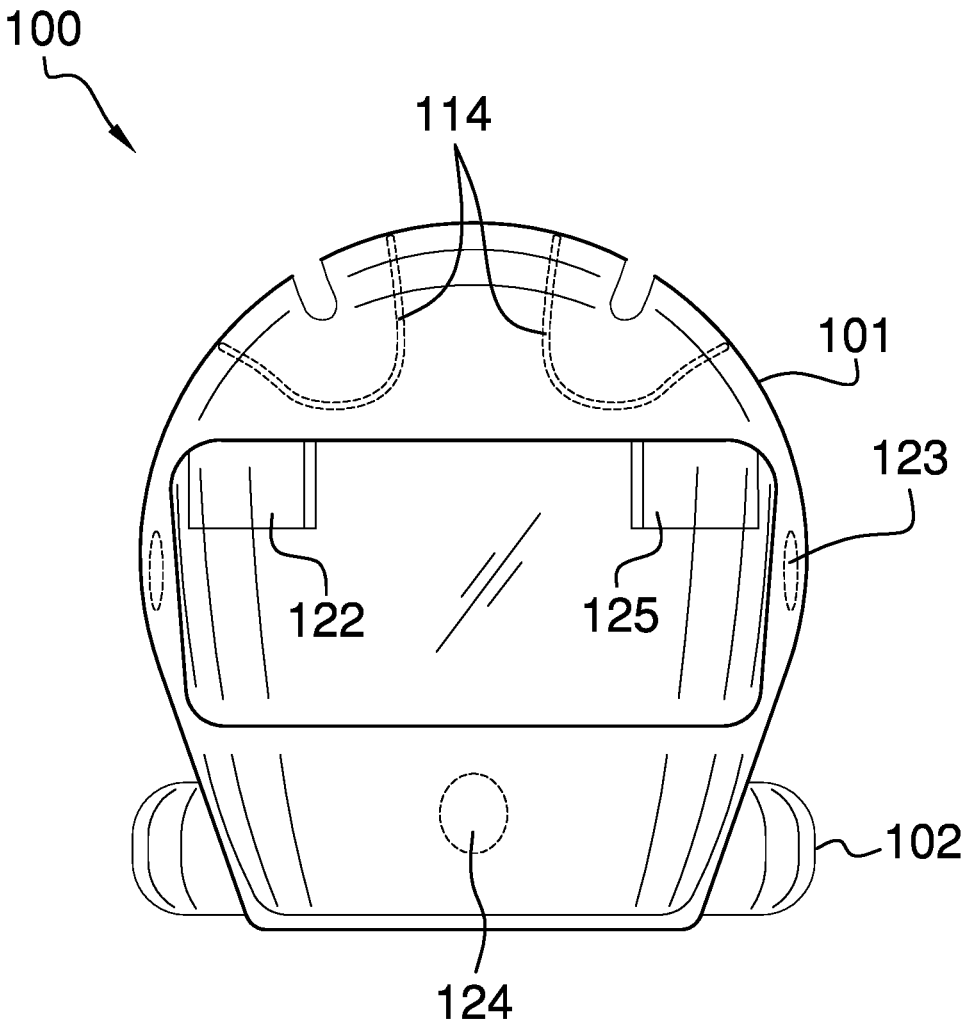
FIG. 2 is a front view of an embodiment of the disclosure.
Figure 3:
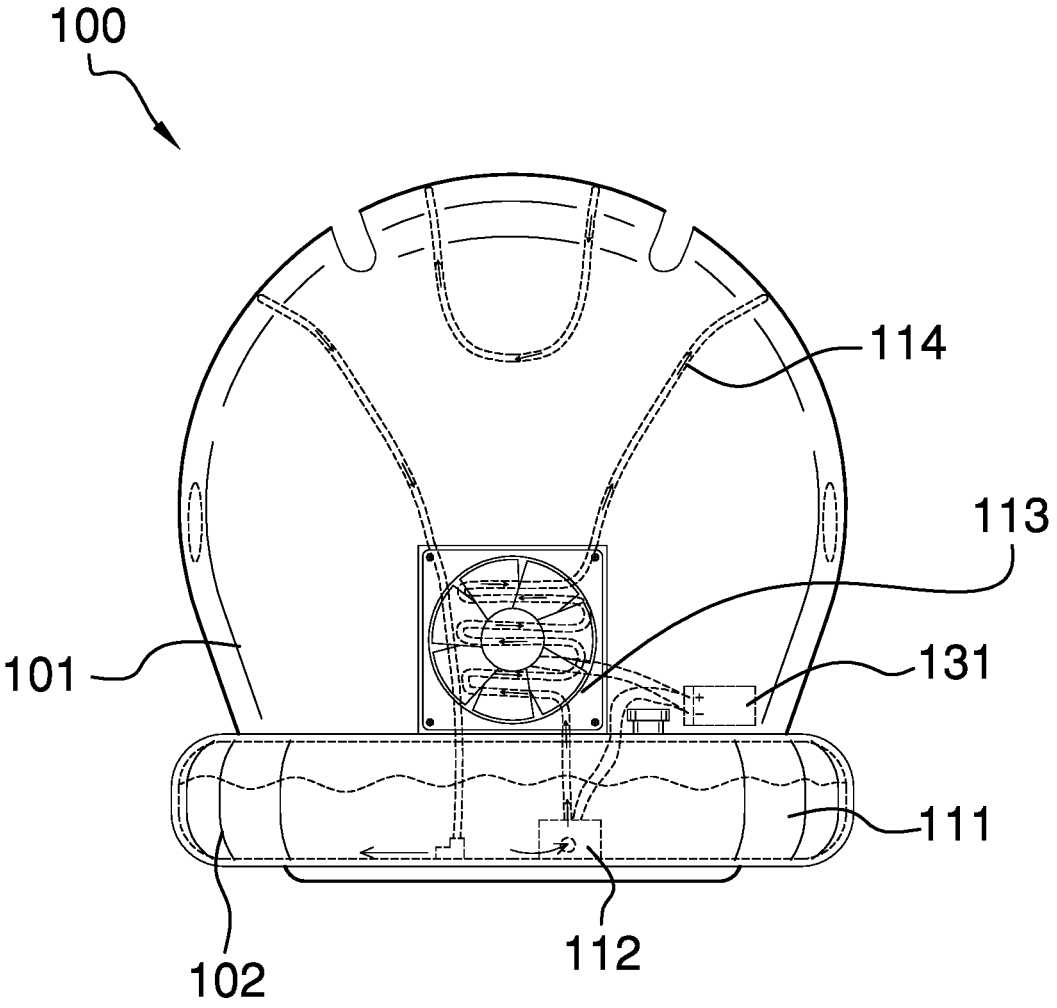
FIG. 3 is a rear view of an embodiment of the disclosure.
Figure 4:
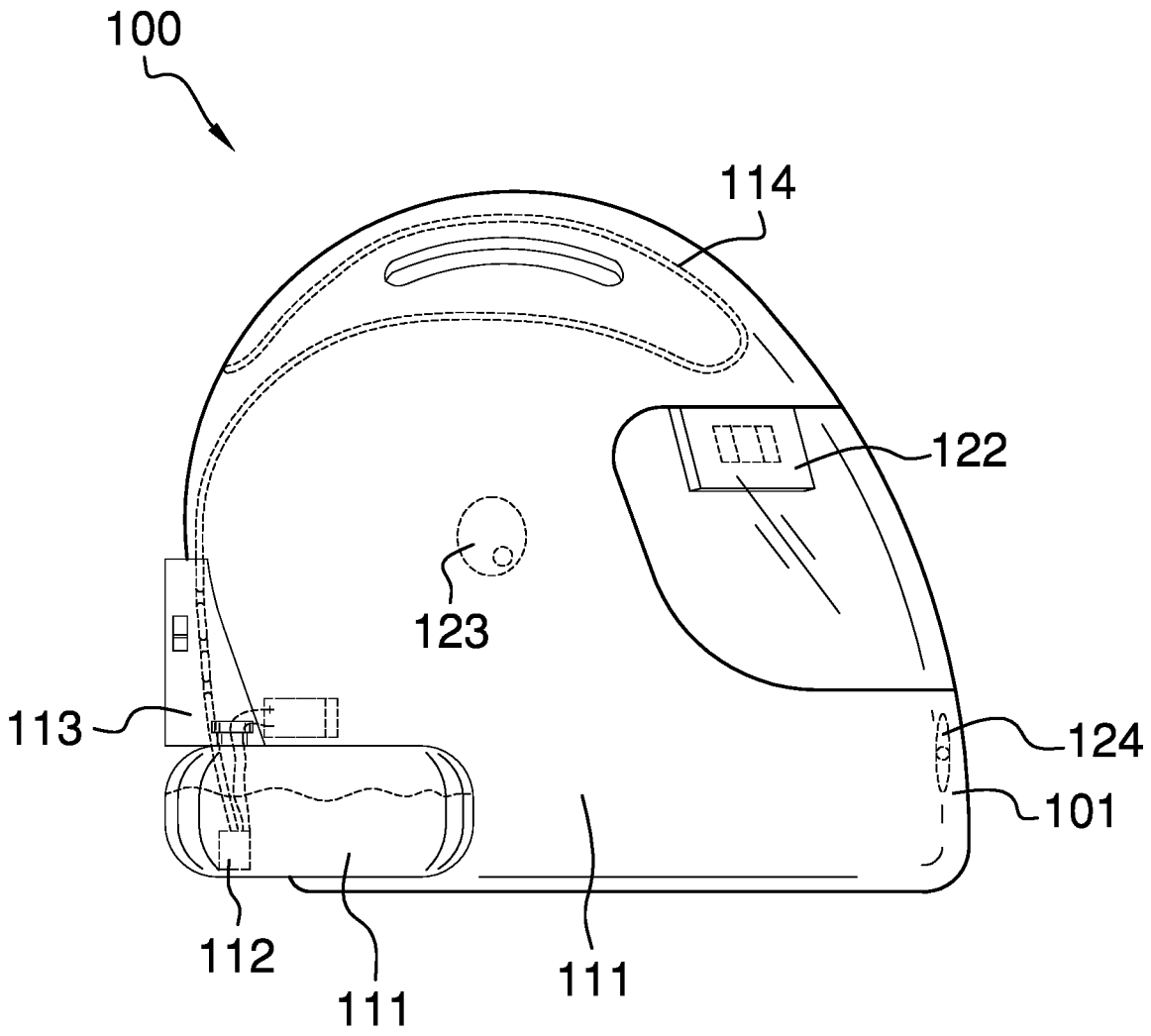
FIG. 4 is a side view of an embodiment of the disclosure.
Figure 5:
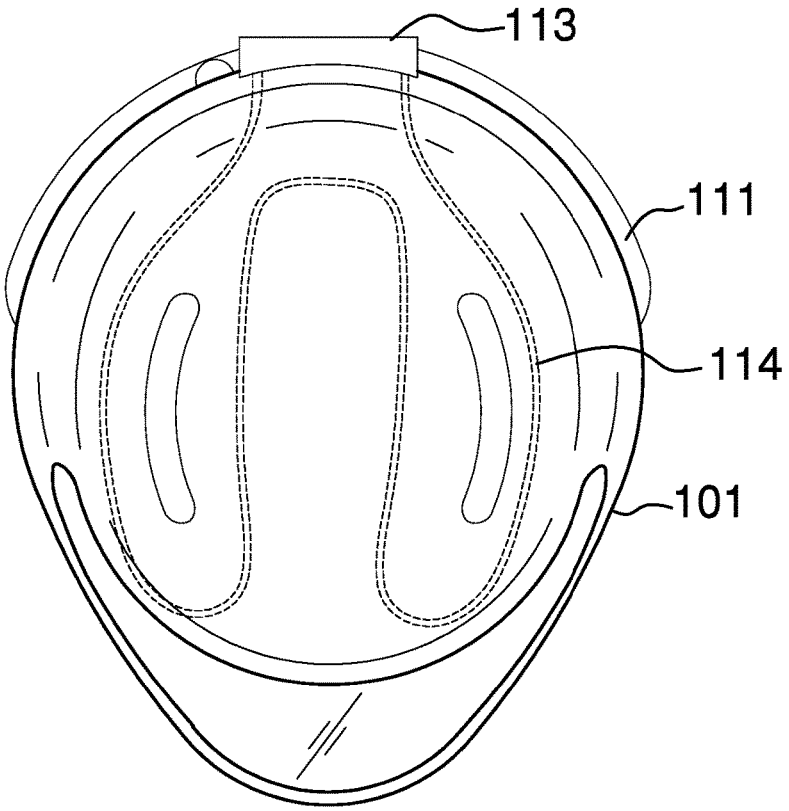
FIG. 5 is a top view of an embodiment of the disclosure.
Figure 6:
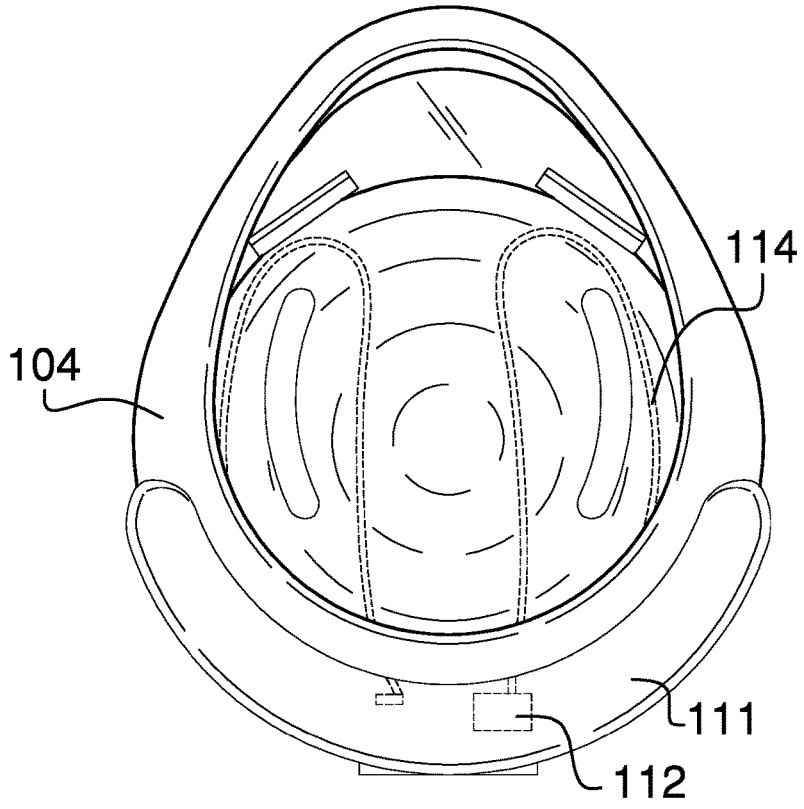
FIG. 6 is a bottom view of an embodiment of the disclosure.
Figure 7:
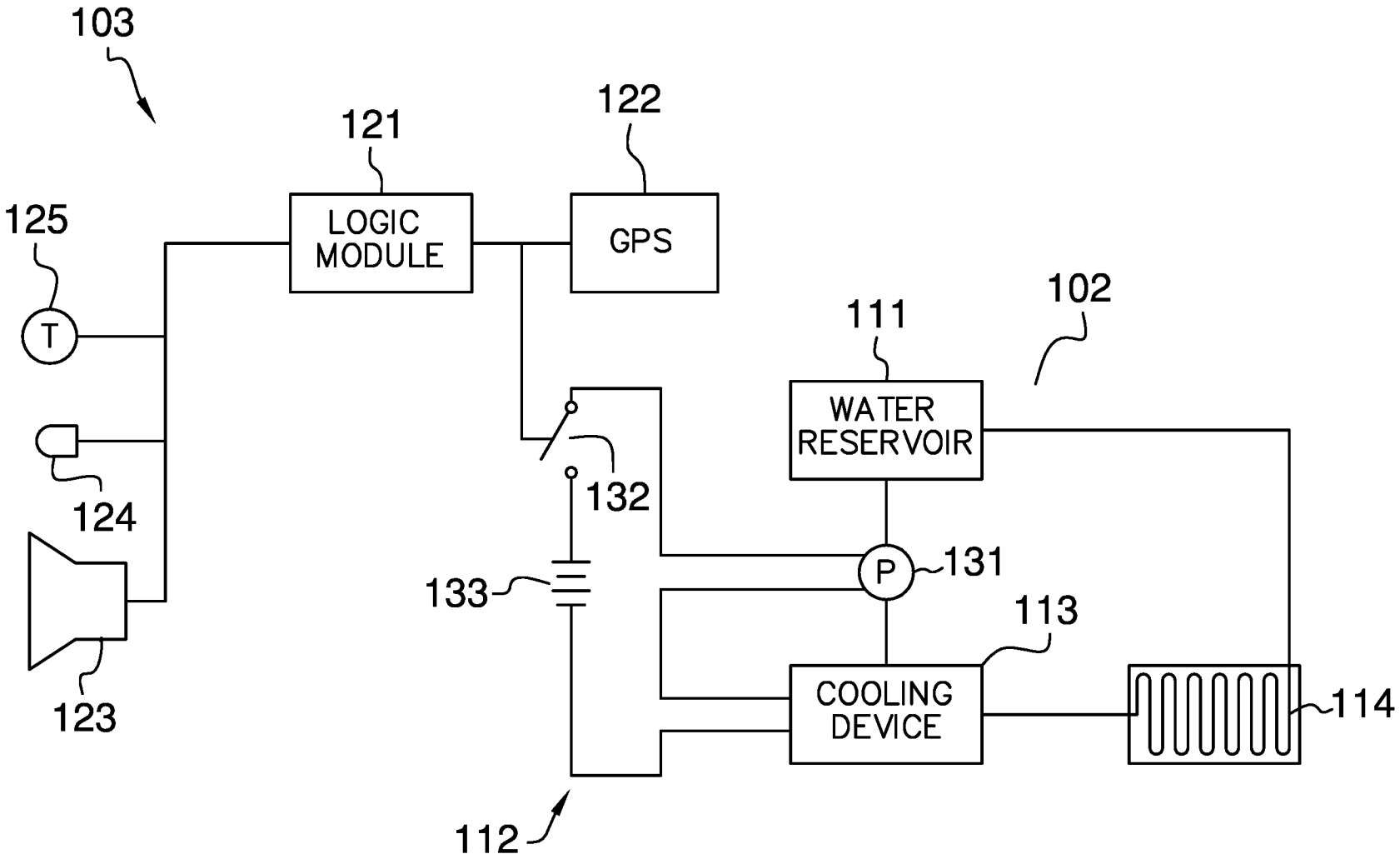
FIG. 7 is a schematic view of an embodiment of the disclosure.

Detailed reference will now be made to one or more potential embodiments of the disclosure, which are illustrated in FIGS. 1 through 5.

The air-conditioned helmet 100 (hereinafter invention) is a protective structure. The invention 100 is configured for use with an individual. The invention 100 forms a protective shell around the head of the individual. The invention 100 is a temperature controlled space within the protective space formed by the invention 100. The invention 100 comprises a helmet structure 101, cooling structure 102, and a control circuit 103. The control circuit 103 and the cooling structure 102 attach to the helmet structure 101. The cooling structure 102 controls the temperature of the protective interior space formed by the helmet. The control circuit 103: a) controls the temperature of the protective space formed by the helmet structure 101; and, b) tracks and announces the GPS coordinates into the protective space formed by the helmet structure 101.

The helmet structure 101 is a protective structure. The helmet structure 101 forms a protective space that encloses the head of an individual. The helmet structure 101 is a motorcycle helmet. The motorcycle helmet is defined elsewhere in this disclosure.

The cooling structure 102 is a mechanical structure. The cooling structure 102 forms a fluidic circuit. The cooling structure 102 pumps water through the fluidic circuit formed by the cooling structure 102. The cooling structure 102 cools the water flowing through the fluidic circuit formed by the cooling structure 102. The cooling structure 102 uses the cooled water as a heat exchange medium used to control the temperature within the protective space formed by the helmet structure 101. The cooling structure 102 comprises a water reservoir 111, a pump structure 112, a cooling device 113, and a hairpin exchanger 114. The water reservoir 111, the pump structure 112, the cooling device 113, and the hairpin exchanger 114 interconnect to form the fluidic circuit.

The water reservoir 111 is a containment structure. The water reservoir 111 stores water that is not flowing through the fluidic circuit formed by the cooling structure 102. The use of a water reservoir 111 is well-known and documented in the mechanical arts.

The pump structure 112 is an electromechanical structure. The pump structure 112 provides the motive forces necessary to pump the water through the fluidic circuit formed by the cooling structure 102. The pump structure 112 generates a pressure differential which is used for transporting the fluid through the water reservoir 111, the cooling device 113, and the hairpin exchanger 114. Specifically, the pump structure 112 pumps water from the water reservoir 111 through the cooling device 113 and the hairpin exchanger 114 back into the water reservoir 111. The pump structure 112 comprises a pump 131, a relay 132, and a battery 133.

The pump 131 is a mechanical device that generates a pressure differential which is used for transporting the fluid through the water reservoir 111, the cooling device 113, and the hairpin exchanger 114. The pump 131 is an electrically powered device. The pump 131 is defined elsewhere in this disclosure. The relay 132 is an electrical device. The relay 132 is a switching device. The relay 132 controls the flow of electricity from the battery 133 to the pump 131. The logic module 121 controls the actuation of the relay 132. The battery 133 is an electrochemical device. The battery 133 converts chemical potential energy into the electrical energy used to power the pump 131.

The cooling device 113 is a first heat exchange device used to cool the water that is flowing through the fluidic circuit formed by the cooling structure 102 as the water is flowing through the fluidic circuit formed by the cooling structure 102. Methods to design, form, and use a cooling device 113 are well-known and documented in the mechanical arts.

The hairpin exchanger 114 is a second heat exchange device. The hairpin exchanger 114 receives the cooled water from the cooling device 113. The hairpin exchanger 114 uses the cooled water as a cooling media that reduces the temperature of the protective space formed by the helmet structure 101. The hairpin exchanger 114 has the structure of a hairpin tube. The terms hairpin exchange and hairpin tube are defined elsewhere in this disclosure.

The control circuit 103 is an electrical circuit. The control circuit 103 controls the temperature within the protective space formed by the helmet structure 101. The control circuit 103 controls the operation of the cooling structure 102. The control circuit 103 tracks the GPS coordinates of the helmet structure 101. The control circuit 103 announces the GPS coordinates of the helmet structure 101 into the protective space formed by the helmet structure 101. The control circuit 103 comprises a logic module 121, a GPS module 122, a speaker 123, a microphone 124, and a thermal sensor 125. The logic module 121, the GPS module 122, the speaker 123, the microphone 124, and the thermal sensor 125 are electrically interconnected.

The logic module 121 is a programmable electronic device that is used to manage, regulate, and operate the cooling structure 102 and the control circuit 103. The logic module 121 monitors the temperature within the protective space formed by the helmet structure 101. The logic module 121 initiates the operation of the cooling structure 102 when the temperature within the protective space formed by the helmet structure 101 is greater than a first previously determined temperature. The logic module 121 discontinues the operation of the cooling structure 102 when the temperature within the protective space formed by the helmet structure 101 is lesser than a second previously determined temperature. The logic module 121 monitors the GPS coordinates of the control circuit 103. The logic module 121 monitors the protective space formed by the helmet structure 101 for a voice command. The logic module 121 announces the GPS coordinates of the control circuit 103 into the protective space formed by the helmet structure 101.

The GPS module 122 is an electrical device that communicates with the GPS to determine the GPS coordinates of the GPS module 122. When queried by the logic module 121, the GPS module 122 transfers the GPS coordinates to the logic module 121.

The speaker 123 is an electrical transducer. The logic module 121 controls the operation of the speaker 123. The speaker 123 receives an electrical signal from the logic module 121. The speaker 123 converts the received electrical signal into an audible announcement made in the protective space formed by the helmet structure 101.

The microphone 124 is an electrical transducer. The logic module 121 monitors electrical signals generated by the microphone 124. The microphone 124 converts audible sounds detected in the protective space formed by the helmet structure 101 into electrical signals that are subsequently transmitted to the logic module 121. The logic module 121 monitors the electrical signals received from the microphone 124 to recognize any voice commands that are generated within the microphone 124. Upon receipt of a voice command through the microphone 124, the logic module 121 gets the GPS coordinates from the GPS module 122 and announces the GPS coordinates of the GPS module 122 into the protective space formed by the helmet structure 101 through the speaker 123.

The speaker 123 and the microphone 124 are well-known and documented electrical devices that are defined elsewhere in this disclosure.

The thermal sensor 125 is an electrical sensor that transmits an electrical signal to the logic module 121. The thermal sensor 125 measures the temperature within the protective space formed by the helmet structure 101. The logic module 121 monitors the electrical signal received from the thermal sensor 125 to determine the temperature in the protective space formed by the helmet structure 101.

The following definitions were used in this disclosure:

Announce: As used in this disclosure, to announce means to generate audible sounds over a transducer.

Battery: As used in this disclosure, a battery is a chemical device consisting of one or more cells, in which chemical energy is converted into electricity and used as a source of power. Batteries are commonly defined with a positive terminal and a negative terminal.

Coil: As used in this disclosure, a coil is a structure that has the shape of a helix, volute, or a spiral. The structure of the coil is often a cord, wire, hose, or tube.

Fluid: As used in this disclosure, a fluid refers to a state of matter wherein the matter is capable of flow and takes the shape of a container it is placed within. The term fluid commonly refers to a liquid or a gas.

Fluidic Circuit: As used in this disclosure, a fluidic circuit is a closed loop path through which a fluid flows. The closed loop will generally initiate and terminate at a reservoir.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Gas: As used in this disclosure, a gas refers to a state (phase) of matter that is fluid and that fills the volume of the structure that contains it. Stated differently, the volume of a gas always equals the volume of its container.

GPS: As used in this disclosure, and depending on the context, GPS refers to: 1) a system of navigational satellites that are used to determine the position, known as GPS coordinates, and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System. Methods to determine the distance and direction between any two sets of GPS coordinates are well-known and documented in the navigational arts.

Hairpin Exchanger: As used in this disclosure, a hairpin exchanger is a heat exchange structure formed a plurality of straight tubes connected using a hairpin tube.

Hairpin Tube: As used in this disclosure, a hairpin tube is a tube or pipe with a non-Euclidean prism structure. The tube or pipe is bent in a "U" shape reminiscent of a hairpin turn. This "U" reverses the actual physical direction of fluid flow while maintaining the direction of the fluid flow through the tube. Hairpin tube structures are often used in heat exchangers.

Helmet: As used in this disclosure, a helmet is an item of personal protective equipment that is configured to be worn on the head of the wearer. The helmet forms a protective space that encloses and protects the wearer's head during impacts.

Liquid: As used in this disclosure, a liquid refers to a state (phase) of matter that is fluid and that maintains, for a given pressure, a fixed volume that is independent of the volume of the container.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Maintained Switch: A used in this disclosure, a maintained switch is a switch that maintains the position that was set in the most recent switch actuation. A maintained switch works in an opposite manner to a momentary switch.

Microphone: As used in this disclosure, a microphone is a transducer that converts the energy from vibration into electrical energy. The sources of vibrations include, but are not limited to, acoustic energy.

Motorcycle: As used in this disclosure, a motorcycle is a commercially available motorized vehicle with two wheels that is intended for carrying one or more passengers.

Motorcycle Helmet: As used in this disclosure, a motorcycle helmet is a piece of protective headgear that provides a chin bar to provide chin and lower face protection during an impact. Motorcycle helmets are worn to protect the users head during impacts. This definition is intended to explicitly include helmets beyond those worn by motorcycle riders including, but not limited to, helmets worn by alpine ski racers or race car drivers. This definition is intended to explicitly exclude "motorcycle" helmets without a chin bar such as "open face," "¾," or "half" helmets.

Non-Euclidean Prism: As used in this disclosure, a non-Euclidean prism is a prism structure wherein the center axis of the prism lies on a non-Euclidean plane or is otherwise formed with a curvature.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Relay: As used in this disclosure, a relay is an automatic electronic, electromagnetic or electromechanical device that reacts to changes in voltage or current by opening or closing a switch in an electric circuit. Relays are further defined with a coil and a switch. Applying a voltage to the coil, usually referred to as energizing the coil, will cause the coil to change the position of the switch. This definition is not intended to preclude the substitution of a transistor for a relay. Within this disclosure, a transistor can be considered as a relay. In this scenario, the base voltage is analogous to the coil of the relay and the current flow from the collector to the emitter is analogous to the operation of the switch of the relay. Those skilled in the electrical arts will recognize that this substitution can be made without undue experimentation. The transistor is defined in greater detail elsewhere in this disclosure.

Reservoir: As used in this disclosure, a reservoir refers to a container or containment system that is configured to store a liquid.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Shell: As used in this disclosure, a shell is a structure that forms an outer covering intended to contain an object. Shells are often, but not necessarily, rigid or semi-rigid structures that are intended to protect the object contained within it.

Speaker: As used in this disclosure, a speaker is an electrical transducer that converts an electrical signal into an audible sound.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Transducer: As used in this disclosure, a transducer is a device that converts a physical quantity, such as pressure or brightness into an electrical signal or a device that converts an electrical signal into a physical quantity.

Transistor: As used in this disclosure, a transistor is a general term for a three-terminal semiconducting electrical device that is used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal. This disclosure assumes the use of an NPN transistor. This assumption is made solely for the purposes of simplicity and clarity of exposition. Those skilled in the electrical arts will recognize that other types of transistors, including but not limited to, field effect transistors and PNP transistors, can be substituted for an NPN transistor without undue experimentation.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vehicle: As used in this disclosure, a vehicle is a device that is used for transporting passengers, goods, or equipment. The term motorized vehicle specifically refers to a vehicle can move under power provided by an electric motor or an internal combustion engine. The term vehicle generically applies to motorized vehicles and vehicles without a motor.

Water: As used in this disclosure, water (CAS 7732-18-5) is a molecule comprising two hydrogen atoms and one oxygen molecule. The phase of water at normal temperature and pressure is liquid. As used in this disclosure, the definition of water is expanded to include dilute water-based solutions of salts and ionic structures using water as the solvent.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An air-conditioned helmet comprising a helmet structure, cooling structure, and a control circuit;

wherein the control circuit and the cooling structure are attached to the helmet structure;

wherein the helmet structure forms a protective space;

wherein the air-conditioned helmet is configured for use with an individual;

wherein the air-conditioned helmet forms a protective shell;

wherein the air-conditioned helmet is a temperature-controlled space within the protective space formed by the air-conditioned helmet;

wherein the cooling structure comprises a water reservoir, a pump structure, a cooling device, and a hairpin exchanger;

wherein the pump structure is an electromechanical structure;

wherein the pump structure is configured to provide the motive forces necessary to pump water through a fluidic circuit formed by the cooling structure;

wherein the pump structure is configured to pump water from the water reservoir through the cooling device and the hairpin exchanger back into the water reservoir;

wherein the cooling structure is configured to control the temperature of the protective space formed by the helmet structure;

wherein the control circuit is configured to control the temperature of the protective space formed by the helmet structure;

wherein the control circuit is configured to track and announce a GPS coordinates into the protective space formed by the helmet structure;

wherein the helmet structure is a protective structure;

wherein the helmet structure is a motorcycle helmet;

wherein the cooling structure is configured to cool the water flowing through the fluidic circuit formed by the cooling structure;

wherein the cooling structure is configured to use the cooled water as a heat exchange medium used to control the temperature within the protective space formed by the helmet structure;

wherein the control circuit is an electrical circuit;

wherein the control circuit is configured to control the operation of the cooling structure;

wherein the water reservoir, the pump structure, the cooling device, and the hairpin exchanger interconnect to form the fluidic circuit;

wherein the control circuit comprises a logic module, a GPS module, a speaker, a microphone, and a thermal sensor;

wherein the logic module, the GPS module, the speaker, the microphone, and the thermal sensor are electrically interconnected;

wherein the water reservoir is a containment structure;

wherein the water reservoir is configured to store water that is not flowing through the fluidic circuit formed by the cooling structure;

wherein the pump structure comprises a pump, a relay, and a battery;

wherein the pump is a mechanical device that is configured to generate a pressure differential which is used for transporting the fluid through the water reservoir, the cooling device, and the hairpin exchanger;

wherein the relay is configured to control the flow of electricity from the battery to the pump;

wherein the battery is an electrochemical device;

wherein the battery is configured to convert chemical potential energy into the electrical energy used to power the pump;

wherein the relay is an electrical device;

wherein the relay is a switching device.

2. The air-conditioned helmet according to claim 1 wherein the cooling device is a first heat exchange device configured to cool the water that is flowing through the fluidic circuit formed by the cooling structure as the water is flowing through the fluidic circuit formed by the cooling structure.

3. The air-conditioned helmet according to claim 2 wherein the hairpin exchanger is a second heat exchange device;

wherein the hairpin exchanger is configured to receive the cooled water from the cooling device;

wherein the hairpin exchanger is configured to use the cooled water as a cooling media that reduces the temperature of the protective space formed by the helmet structure;

wherein the hairpin exchanger has the structure of a hairpin tube.

4. The air-conditioned helmet according to claim 3 wherein the logic module is configured to control the actuation of the relay;

wherein the logic module is a programmable electronic device;

wherein the logic module is configured to monitor the temperature within the protective space formed by the helmet structure;

wherein the logic module is configured to initiate the operation of the cooling structure when the temperature within the protective space formed by the helmet structure is greater than a first previously determined temperature;

wherein the logic module is configured to discontinue the operation of the cooling structure when the temperature within the protective space formed by the helmet structure is lesser than a second previously determined temperature;

wherein the logic module is configured to monitor the GPS coordinates of the control circuit;

wherein the logic module is configured to monitor the protective space formed by the helmet structure for a voice command;

wherein the logic module is configured to announce the GPS coordinates of the control circuit into the protective space formed by the helmet structure.

5. The air-conditioned helmet according to claim 4 wherein the GPS module is an electrical device configured to communicate with the GPS to determine the GPS coordinates of the GPS module;

wherein the GPS module is configured to transfer the GPS coordinates to the logic module.

6. The air-conditioned helmet according to claim 5 wherein the speaker is an electrical transducer;

wherein the logic module is configured to control the operation of the speaker;

wherein the speaker is configured to receive an electrical signal from the logic module;

wherein the speaker is configured to convert the received electrical signal into an audible announcement made in the protective space formed by the helmet structure.

7. The air-conditioned helmet according to claim 6 wherein the microphone is an electrical transducer;

wherein the logic module is configured to monitor electrical signals generated by the microphone;

wherein the microphone is configured to convert audible sounds detected in the protective space formed by the helmet structure into electrical signals that are subsequently transmitted to the logic module;

wherein the logic module is configured to monitor the electrical signals received from the microphone to recognize any voice commands that are generated within the microphone.

8. The air-conditioned helmet according to claim 7 wherein upon receipt of a voice command through the microphone, the logic module is configured to receive the GPS coordinates from the GPS module and is configured to announce the GPS coordinates of the GPS module into the protective space formed by the helmet structure through the speaker.

9. The air-conditioned helmet according to claim 8 wherein the thermal sensor is an electrical sensor that is configured to transmit an electrical signal to the logic module;

wherein the thermal sensor is configured to measure the temperature within the protective space formed by the helmet structure.

10. The air-conditioned helmet according to claim 9 wherein the logic module is configured to monitor the electrical signal received from the thermal sensor to determine the temperature in the protective space formed by the helmet structure.

* * * * *